United States Patent [19]

Dydyk

[11] Patent Number: 4,706,049

[45] Date of Patent: Nov. 10, 1987

[54] DUAL ADJACENT DIRECTIONAL FILTERS/COMBINERS

[75] Inventor: Michael Dydyk, Scottsdale, Ariz.

[73] Assignee: Motorola, Inc., Schaumburg, Ill.

[21] Appl. No.: 783,881

[22] Filed: Oct. 3, 1985

[51] Int. Cl.[4] ..... H01P 1/213; H01P 5/18

[52] U.S. Cl. ..... 333/110; 333/204; 333/126; 333/134

[58] Field of Search ..... 333/110, 113, 134, 129, 333/126, 135, 204

[56] References Cited

U.S. PATENT DOCUMENTS

| | | | |
|---|---|---|---|
| 2,922,123 | 1/1960 | Cohn | 333/110 |
| 3,092,790 | 6/1963 | Leake et al. | 333/110 |
| 3,447,102 | 5/1969 | Gerwartowski | 332/30 |
| 3,560,887 | 2/1971 | Napoli et al. | 333/110 |
| 3,678,415 | 7/1972 | Kuroda | 333/117 |
| 4,061,990 | 12/1977 | Ueno | 333/110 |
| 4,264,881 | 4/1981 | De Ronde | 333/110 |
| 4,287,605 | 9/1981 | Dydyk | 455/330 |
| 4,457,022 | 6/1984 | Dydyk | 455/317 |

OTHER PUBLICATIONS

Cohn, S. B. and Coale, F. S.; "Directional Channel-Separation Filters"; *Proceedings of the IRE;* Aug. 1956 issue; pp. 1018–1024.

Kamazawa et al; "A 30 Ghz Band Periodic Filter with a Ring Resonator"; *Electronics and Communications in Japan;* vol. 59-B, No. 1; Jan. 1976; pp. 78–86.

*Primary Examiner*—Eugene R. LaRoche
*Assistant Examiner*—Benny Lee
*Attorney, Agent, or Firm*—Maurice J. Jones, Jr.; Eugene A. Parsons

[57] ABSTRACT

A dual adjacent directional filter is disclosed for the splitting and combining of signals. This device is composed of a six port filter wherein if the appropriate signal is entered into the center port two signals having the same frequency as the input signal and equally divided amplitudes will output to the corresponding two output ports. This device is comprised of two transmission lines being equally divided by an impedance matching transmission line. Between the impedance matching transmission line and the regular transmission lines is located a filtering device of either a loop type transmission line; resonator; or transmission stubs.

9 Claims, 10 Drawing Figures

-PRIOR ART-

-PRIOR ART-

-PRIOR ART-

DUAL ADJACENT DIRECTIONAL FILTERS/COMBINERS

BACKGROUND OF THE INVENTION

This invention relates, in general, to directional filters/combiners and, more particularly, to dual adjacent directional filters/combiners.

Various types of directional filters are known in the art. See U.S. Pat. Nos. 2,922,123 entitled "Directional Filters for Strip-Line Transmission Systems" invented by S. B. Cohn; 3,447,102 entitled "Microwave Frequency Converting Comprising Multi-Port Directional Couplers" invented by J. W. Gewartowski; and 4,287,605 entitled "Directional Filter for Mixers, Converters and the Like" invented by Micheal Dydyk. While these devices can be modified to provide the signal splitting/combining provided by the dual adjacent directional filters, as will be seen below, excessive components are required which result in additional losses; require more space; and are more expensive.

SUMMARY OF THE INVENTION

Accordingly, it is an object of the present invention to provide a dual adjacent directional filter/combiner and method that overcomes the deficiencies set out above.

A further object of the present invention is to provide a dual adjacent directional filter/combiner that requires fewer components than the prior art.

Another object of the present invention is to provide a dual adjacent directional filter and method that has fewer losses than known in the prior art.

Still another object of the present invention is to provide a dual adjacent directional filter/combiner that requires less space.

Yet another object of the present invention is to provide a dual adjacent directional filter/combiner that is more economical to produce.

The above and other objects and advantages of the present invention are provided by an apparatus and method of combining directional filters in a way to provide maximum quality or Q.

A particular embodiment of the present invention consists of a dual adjacent directional filter (DADF) for filtering/combining a signal having a wavelength ($\lambda_g$), said DADF having a first, second, third, fourth, fifth and sixth ports, the DADF comprising: first and second transmitting means for transmitting the signal; the second transmitting means being juxtaposed to the first transmitting means; impedance matching means for matching impedances having a first end and second end, the first end being coupled to the first port of the DADF, the second end being coupled to the second port of the DADF and the impedance matching means being disposed between the juxtaposed to the first and second transmission means; first filtering means for filtering a portion of the signal, the first filtering means being disposed between the first transmission line and the impedance matching means; and second filtering means for filtering a remaining portion of the signal, the second filtering means being disposed between the second transmission line and the impedance matching means.

DETAILED DESCRIPTION OF THE DRAWINGS

Figure 1:
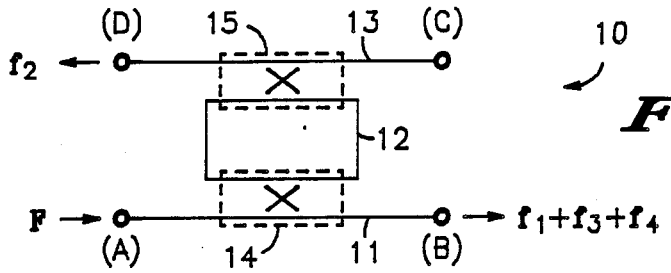
FIG. 1 is a schematic illustration of a prior art directional filter.

Referring to the diagram of FIG. 1, a prior art directional filter, generally designated 10, is illustrated. Directional filter 10 consists of three strip lines 11, 12 and 13. Strip lines 11 and 13 are parallel to each other but not directly coupled. Strip line 12 is in the form of a rectangle located between lines 11 and 13 and form directional couplings 14 and 15 with lines 11 and 13. Strip line 12 is selected to have a length equal to the wavelength of the frequency of the signal desired to be filtered.

Figure 2:
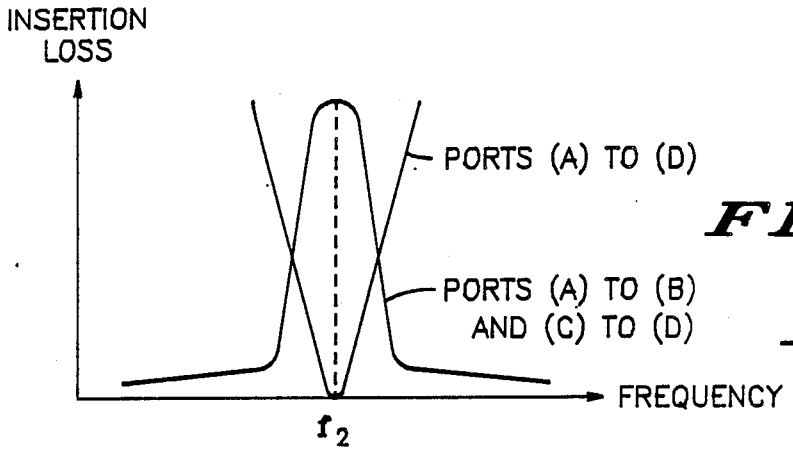
FIG. 2 is a graphic representation of the frequency response of the directional filter illustrated in FIG. 1.

By way of example, if a signal, F, consisting of the signals $f_1+f_2+f_3+f_4$, enters a port (A) of filter 10; and if line 12 is set equal to the wavelength of signal $f_2$, then signal $f_2$ will be filtered out. As a result the signal $f_2$ will appear at port (D) and the remaining portion of signal F, $(f_1+f_3+f_4)$ will appear at port (B). Shown graphically in FIG. 2 the insertion loss between ports (A) and (D) is lowest at frequency $f_2$ while the insertion loss between ports (A) and (B) is maximum at frequency $f_2$. This indicates that the signal having frequency $f_2$ is transferred to line 13 with no insertion loss. It should be noted here that this data is for an ideal model and in actual use there would be some insertion loss.

Figure 3:
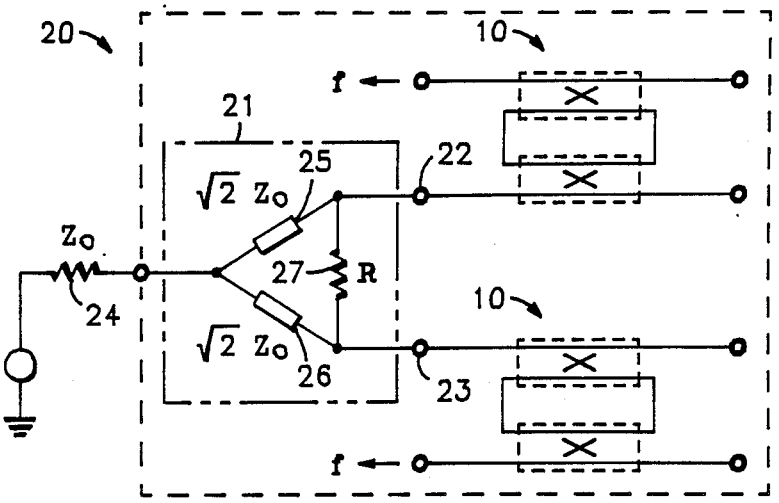
FIG. 3 is a schematic illustration of a prior art signal splitter/combiner.

Referring now to FIG. 3, a prior art signal filter/-combiner, generally designated 20, is illustrated. Signal filter/combiner 20 consists of a power splitter 21 and two directional filters 10. Signal filter/combiner 20 is shown here having an input load 24 of $Z_0$. Power splitter 21 has three ports: the first port is coupled to load 24; the second port 22 is coupled to one of the directional filters 10; and a third port 22 is coupled to the second directional filter 10. Power splitter 21 consists of a first impedance 25 of $\sqrt{2}Z_0$ coupled between the first and second ports; a second impedance 26 of $\sqrt{2}Z_0$ coupled between the first and the third ports; and a resistor 27, R, coupled between the second and third ports.

In operation a signal enters power splitter 21 at the first port and is evenly split. The divided signals are then transmitted out the second and third ports to their respective directional filters 10 where the desired frequency is filtered out. The results of this is a pair of signals f, with output having equally divided power and having the same frequency.

Figure 4:
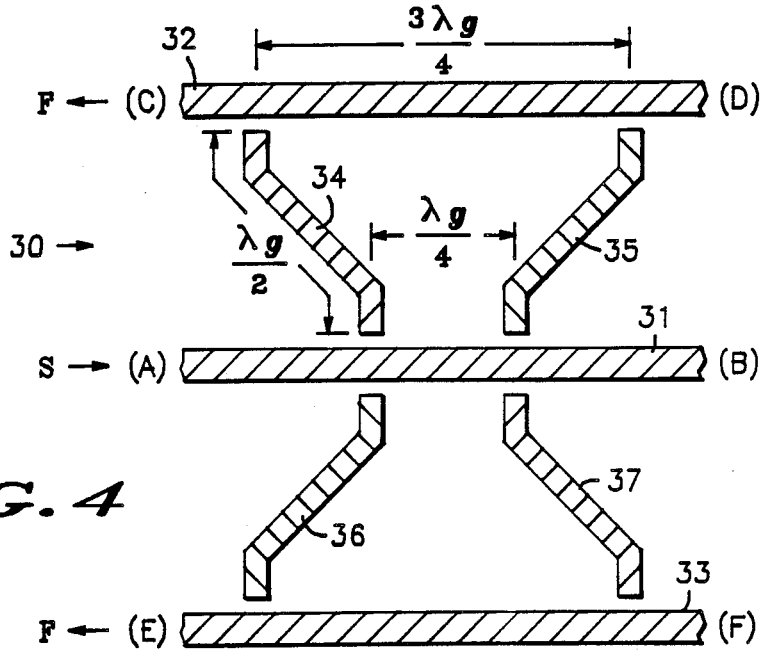
FIG. 4 is a schematic illustration of a dual adjacent directional filter/combiner embodying the present invention.

Turning now to FIG. 4 a dual adjacent directional filter/combiner (DADF), generally designated 30, embodying the present invention is illustrated. DADF 30 consists of three parallel strip lines 31, 32, and 33. Located between lines 31 and 32 are a pair of strip lines 34 and 35. Between lines 31 and 33 are also a pair of strip lines 36 and 37.

Lines 34 and 35 are of a length equal to one-half the wavelength, $\lambda_g$, of the signal being filtered. Lines 34 and 35 are disposed such that the ends near line 31 are spaced one-quarter wavelength apart ($\lambda_g/4$) and the ends near line 32 are spaced three-quarters wavelength ($3\lambda_g/4$) apart. Line 36 and 37 between lines 31 and 33 are the mirror image of lines 34 and 35.

In operation, a signal S, enters port (A) of DADF 30. The signal is then filtered for a frequency F having a wavelength $\lambda_g$. The signal S is split and a pair of signals having equally divided power and having frequency F are output from ports (C) and (E) of DADF 30. Any remaining portions of signal S appear in port (B).

Figure 5:
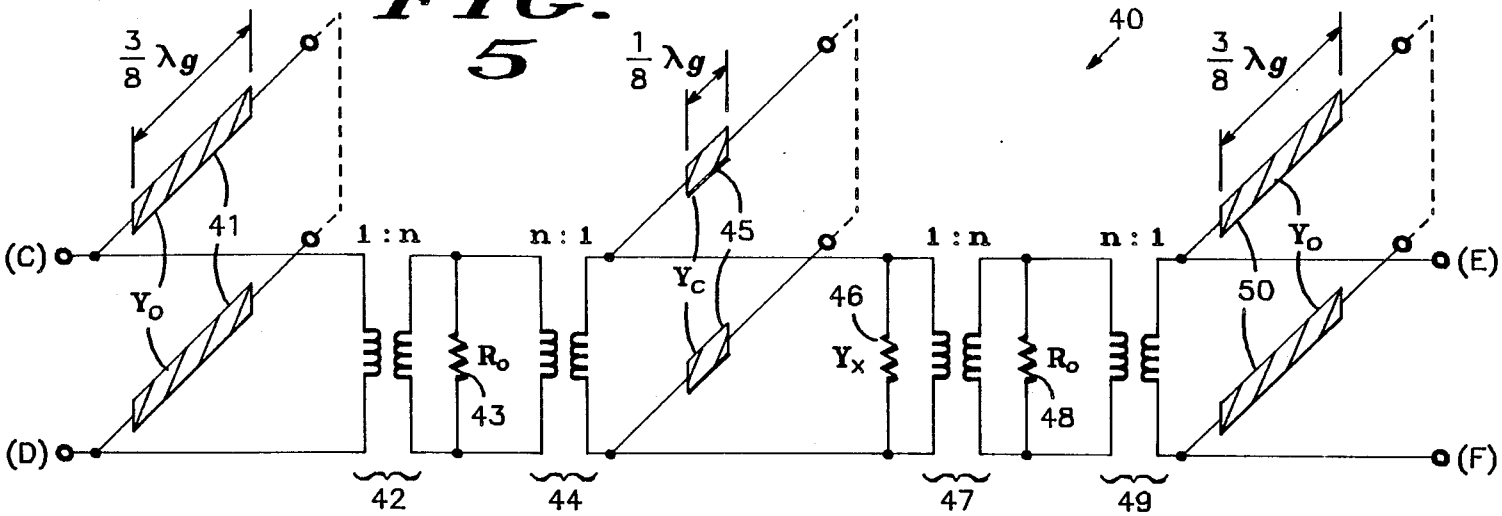
FIG. 5 is a schematic circuit of an equivalent circuit of the dual adjacent directional filter of FIG. 4.

An analysis of DADF 30 may be performed by applying symmetry considerations to DADF 30 of FIG. 4 and then reducing the topology to an equivalent circuit. Taking a vertical plane of symmetry, an equivalent circuit, generally designated 40, FIG. 5, is derived. Taking circuit 40 from left to right ports (C) and (D), equivalent to ports (C) and (D) of FIG. 4 are encountered.

Next, a pair of stubs 41 each having a length ($3\lambda_g/8$) are encountered. These stubs represent the admittance $Y_0$ of transmission line 32, FIG. 4. A dash line between the end ports of stub 41 represents a short or open circuited load, representing odd or even symmetry. The gap between lines 32 and 34 is represented by an ideal transformer, 42, of 1:n. The resistance of line 34 is represented by resistor 43 as $R_0$. The half-wavelength strips are considered to be at resonance. A transformer 44 is coupled in parallel with resistor 43 representing the gap between lines 34 and 31. A pair of stubs 45, each having a length ($\lambda_g/8$), are coupled to transformer 44. Stubs 45 have an admittance $Y_c$. Stubs 45 are also shown with a dash line representing a short or open circuit. Next, a resistor 46 having an admittance $Y_x$ is shown. Admittance $Y_x$ represents the loads that terminate ports (A) and (B).

A transformer 47 (1:n) is coupled in parallel with resistor 46. Transformer 47 represents the gap between lines 31 and 36. A resistor 48, $R_0$, is coupled in parallel with transformer 47. Resistor 48 represents the resistance of line 36. Next, another transformer, 49, (n:1) is coupled to resistor 48. Finally, a pair of stubs, 50, each having a length of ($3\lambda_g/8$) are coupled to transformer 49. Stubs 50 have a combined admittance of $Y_0$ and are joined at one end by a dashed line representing an open or short circuit.

Using the equivalent circuit of FIG. 5 an ABCD matrix can be generated and used to determine the odd and even reflection and transmission coefficients. These coefficients will then be used to determine the overall 4 port scattering matrix defined by ports (C), (D), (E) and (F).

The ABCD matrix for the equivalent circuit is:

$$\begin{bmatrix} A & B \\ C & D \end{bmatrix} = \begin{bmatrix} 1 & 0 \\ 2Y_o/\beta + Y_x + j(\pm Y_c \mp 2Y_o) & 1 \end{bmatrix} \quad (1)$$

where:

$Y_0$=characteristic admittance between transmission line (C)-(D) or (E)-(F);

$Y_x$=characteristic admittance of the loads at ports (A) or (B);

$Y_c$=characteristic admittance between transmission line (A)-(B); and $\beta$=the coupling coefficient which can be defined by the equation:

$$\beta = R_o/(Z_o n^2) \quad (2)$$

where:

$R_0$=the resistance (representing the resonator's loss) of the half-wavelength lines 34, 35, 36 or 37;

$Z_0$=characteristic impedance between transmission lines (C)-(D) or (E)-(F); and n=the transformation ratio of transformers 42, 44, 47 and 49.

If the requirement is placed on element C of the ABCD matrix, equation (1), that it be purely a real number then:

$$\pm Y_c \mp 2Y_o = 0 \quad (3)$$

or, $$Y_c = 2Y_o. \quad (4)$$

The reflection, R, and transmission, T coefficients are related to the matrix in equation (1) by the following two equations:

$$R = \frac{AZ_L + B - Z_L Z_g C - Z_g D}{AZ_L + B + Z_L Z_g C + Z_g D} \quad (5)$$

and $$T = \frac{2\sqrt{Z_2 Z_g}}{AZ_L + B + Z_L Z_g C + Z_g D} \quad (6)$$

where:

$Z_L$=the load impedance (not shown); and $Z_g$=the generator impedance (not shown).

If equation (4) is substituted into equation (1), element C, and the result into equations (5) and (6) the following are derived;

$$R = \frac{-(2/\beta) + Y_x Z_o}{2 + (2/\beta) + Y_x Z_o} \quad (7)$$

and $$T = \frac{2}{2 + (2/\beta) + Y_x Z_o} \quad (8)$$

In this case the even, $R_e$, and odd, $R_o$ reflection coefficients are the same and equal to R in equation (7). The even, $T_e$, and odd, $T_o$, transmission coefficients are also the same and equal to T in equation (8).

The four port scattering matrix for the equivalent circuit of FIG. 5 is:

$$[S] = (\tfrac{1}{2})\begin{bmatrix} R_e + R_o & R_e - R_o & T_e + T_o & T_e - T_o \\ R_e - R_o & R_e + R_o & T_e - T_o & T_e + T_o \\ T_e + T_o & T_o - T_o & R_e + R_o & R_e - R_o \\ T_e - T_o & T_e + T_o & R_e - R_o & R_e + R_o \end{bmatrix} \quad (9)$$

Substituting equations (7) and (8) into (9) results in a scattering matrix of:

$$[S] = \begin{bmatrix} R & O & T & O \\ O & R & O & T \\ T & O & R & O \\ O & T & O & R \end{bmatrix} \quad (10)$$

The expectation for the vertical symmetry plane we are working with is that when ports (C) and (E) are excited, all the energy from the signals at the desired frequency will be combined and output through ports (A) or (B). The remaining signals will output through ports (D) and (F). This expectation can be shown mathematically by using equation (10) as follows:

$$\begin{bmatrix} B_C \\ B_D \\ B_E \\ B_F \end{bmatrix} = \begin{bmatrix} R & O & T & O \\ O & R & O & T \\ T & O & R & O \\ O & T & O & R \end{bmatrix} \begin{bmatrix} A_C \\ O \\ A_E \\ O \end{bmatrix} \quad (11)$$

where:

$B_C$, $B_D$, $B_E$, and $B_F$, are constants representing the reflection signals, or signals leaving the circuit, at ports (C), (D), (E), and (F) of FIG. 5; and $A_C$ and $A_E$ represents the signals incident to, or entering the circuit, at ports (C) and (E) of FIG. 5. Solving equation (11) results in:

$$B_C = RA_C + TA_E$$

$$B_D = 0$$

$$B_E = TA_C + RA_E$$

$$B_F = 0. \quad (12)$$

This shows that the signal reflected out of port (C), $B_C$, is a combination of the reflected portion of the signal incident to port (C), $A_C$, and the transmitted portion of the signal incident to port (E), $A_E$. The signal reflected out of port (E), $B_E$, is a combination of the transmitted portion of the signal incident to port (C), $A_C$, and the reflected portion of the signal incident to port (E), $A_E$. As discussed above, with respect to FIG. 1, if the signal entering ports (C) and (E) are of a frequency having the wave length the filter is set to; then none of the signals will pass to ports (D) and (F). Therefore, the reflected signals out of ports (D) and (F) are 0. Assuming that the signals incident to ports (C) and (E), $A_C$ and $A_E$ respectively, are the same signals then:

$$A_c = A_E = A. \quad (13)$$

If the ideal situation is used then there is no reflected signal out of ports (C) and (E), therefore:

$$B_c = B_E = 0. \quad (14)$$

Substituting these into equations (12) results in:

$$0 = RA + TA \text{ and}$$

$$0 = TA + RA \quad (15)$$

Which reduces to:

$$R = -T. \quad (16)$$

If no energy is lost to ports (D) and (F) and none is reflected ($B_C = B_D = B_E = B_F = 0$), then all power must be combined in $Y_x$, the loads of ports (A) and (B) of FIG. 5. For this to occur the following equation must be satisfied:

$$2/\beta + Y_x Z_o = 2 \quad (17)$$

or, $$Y_x = 2Y_o(1 - 1/\beta) \quad (18)$$

This shows that a quarter-wavelength transformer is required between ports (A) and (B).

If the rule of reciprocity is invoked then if energy combines it must also split. Therefore, a filter is provided that equally divides the power of a signal that is at the appropriate frequency, having a wavelength ($\lambda_g$).

Figure 6:
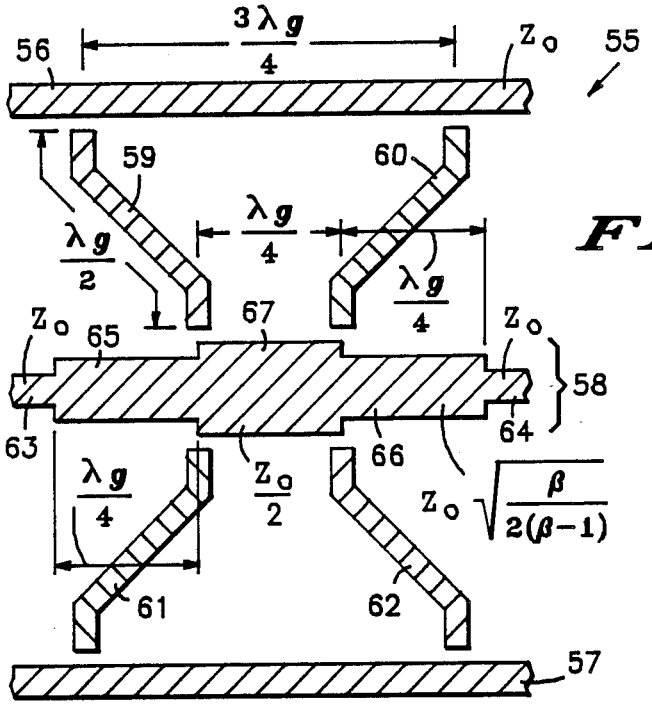
FIG. 6 is a schematic illustration of a dual adjacent directional filter embodying the present invention.

Referring now to FIG. 6, a dual adjacent directional filter/combiner, generally designated 55, embodying the present invention is illustrated. DADF 55 consists of a first transmission line 56, a second transmission line 57 and a third transmission line 58. Located between transmission lines 56 and 58 are a pair of half-wavelength strips 59 and 60. The ends of strips 59 and 60 disposed near line 56 are spaced three-quarters wavelength ($3\lambda_g/4$) apart. The end of strips 59 and 60 disposed near line 58 are spaced one-quarter wavelength ($\lambda_g/4$) apart. Located between transmission lines 58 and 57 is the second pair of half-wavelength strips ($\lambda_g/2$) 61 and 62. The ends of strip 61 and 62 disposed near line 57 are spaced three-quarters wavelength ($3\lambda_g/4$) apart. The ends of strip 61 and 62 disposed near line 58 are spaced one-quarter wavelength ($\lambda_g/4$) apart. Transmission line 58 is composed of several lesser transmission lines coupled together, end to end, so as to look like transformers. A pair of outer transmission lines, 63 and 64, have an impedance of $Z_0$, and are coupled at their inner ends to middle transmission lines 65 and 66, which are one-quarter wavelength ($\lambda_g/4$) long. Each of lines 65 and 66 are then coupled to a central transmission line 67 also having a length of one-quarter wavelength ($\lambda_g/4$).

The impedance of line 67, $Z_C$, is determined by equation (4) which can be rewritten in impedance form as:

$$1/Z_C = 2(1/Z_0) \quad (19)$$

or, $$Z_C = Z_0/2. \quad (20)$$

Therefore, the characteristic impedance of the center transmission line 67 is $Z_C$ or $Z_0/2$. Here it should be noted that FIG. 5 can also be used as an equivalent circuit for the embodiment illusated in FIG. 6, and in this case transmission line 67 is represented by stubs 45 of FIG. 5.

Figure 7:
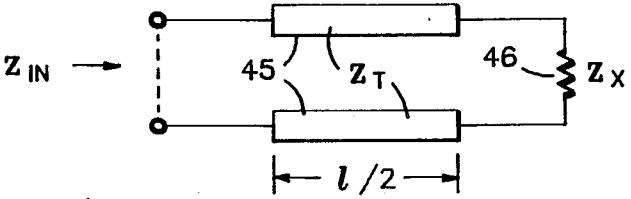
FIG. 7 is a schematic illustration of a portion of the equivalent circuit of FIG. 5.

Next, the realization of impedance $Z_X$ of resistor 46 in FIG. 5 is determined with the help of FIG. 7. FIG. 7 shows a transmission line 45, having a characteristic impedance of $Z_T$, and resistor 46, having an impedance $Z_X$. The impedance looking into the circuit of FIG. 7 is represented by $Z_{in}$. The impedance $Z_{in}$, (at a frequency where$=\lambda_g/4$) can be represented by the equation:

$$Z_{in}\Big|_{l=\lambda_g/4} = Z_T^2/Z_X \tag{21}$$

where l=length of the transmission line with characteristic impedance of $Z_T$.

In order to maintain a constant impedance match, $Z_{in}$ has to be equal to $Z_0$. This can be illustrated by the following equation:

$$Z_{in}\Big|_{l=\lambda_g/4} = Z_T^2/Z_X = Z_O. \tag{22}$$

Solving equation (22) for $Z_T$ results in:

$$Z_T = \sqrt{Z_O Z_X}\ . \tag{23}$$

Substituting impedances for admittances in equation (18) and solving for $Z_X$ results in:

$$Z_X = (Z_0\beta/[2(\beta-1)]). \tag{24}$$

Substituting equation (24) into equation (23) and solving for $Z_T$ results in:

$$Z_T = Z_O\sqrt{\beta/[2(\beta-1)]}\ . \tag{25}$$

Therefore, the characteristic impedance of each of the lines 65 and 66, FIG. 6, is represented by $Z_T$.

As can be seen by a comparison of FIGS. 3 and 6 the present invention provides a DADF that has fewer parts. The reduction in parts translates into a reduced power loss. In addition, the device in FIG. 6 requires less room to implement making more economic use of the available space.

Figure 8:
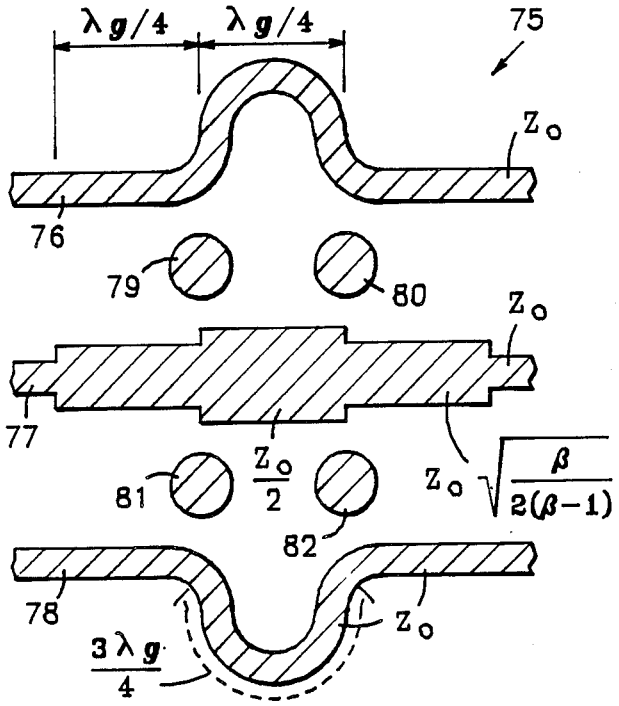
FIG. 8 is a schematic illustration of a second embodiment of a dual adjacent directional filter/combiner incorporating the present invention.

Referring now to the schematic diagram of FIG. 8, a second embodiment of a dual adjacent directional filter/combiner, generally designated 75, is illustrated. DADF 75 consists of three transmission lines, 76, 77 and 78, and two pair of dielectric resonators, 79, 80, 81, and 82. As can be seen by comparing FIGS. 6 and 8 these circuits will operate identically.

The central transmission lines, 63 in FIGS. 6 and 77 in FIG. 8, are identical. Stubs 59, 60, 61 and 62 of FIG. 6 have been replaced by resonators 79, 80, 81, and 82 in FIG. 8. To accommodate for the change from strip lines to resonators, lines 76 and 78 have a three-quarters wavelength ($3\lambda_g/4$) curve placed in them that has the two ends spaced one-quarter wavelength ($\lambda_g/4$) apart.

Figure 9:
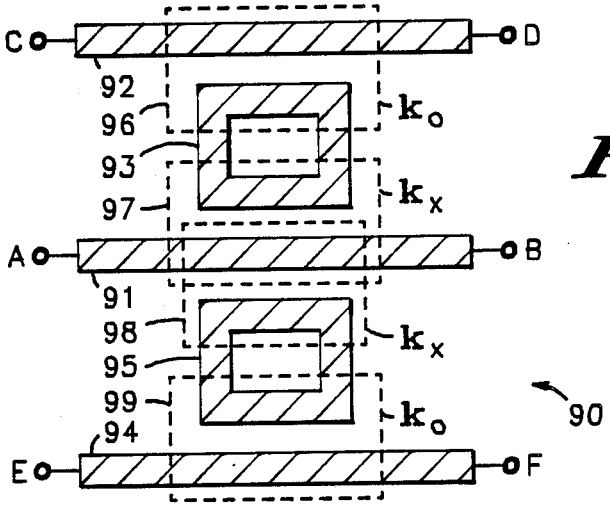
FIG. 9 is a schematic illustration of a third embodiment of a dual adjacent directional filter/combiner incorporating the present invention.

Referring now to the diagram of FIG. 9 a third embodiment of a dual adjacent directional filter/combiner, generally designated 90, is illustrated, DADF 90 consists of a pair of directional filters. One directional filter is represented by transmission lines 91 and 92 being disposed on opposite sides of a one-wavelength loop 93. The second directional filter consists of transmission lines 91 and 94 which are separated by a one-wavelength loop 95.

Loop 93 and line 92 have a coupling coefficient, $k_o$, represented by the dash line 96; loop 93 and line 91 have a coupling coefficient, $k_x$ represented by dash line 97; loop 95 and line 91 have a coupling coefficient, $k_x$, represented by dash line 98; and loop 95 and line 94 have a coupling coefficient, $k_o$, represented by dash line 99.

By selecting the coupling coefficients and determining the loads based on these coupling coefficients, the circuit in FIG. 9 will operate as a dual adjacent directional filter/combiner. This can be shown through the following analysis.

In order to establish the operability of the device in FIG. 9 as a dual adjacent directional filter/combiner, symmetry must be used to analyze the circuit. By utilizing an even symmetry approach with respect to the horizontal line (running from port (A) to port (B)), an equivalent circuit to circuit to 90 can be derived. See circuit shown in FIG. 10. As can be seen, DADF 90 has been reduced to a pair of parallel transmission lines, 100 and 101, and a transmission loop 102 being a full wavelength. Four ports are shown 103–106. Ports 103 and 104 have terminating impedances 107 and 108 each being $2Z_0$. Ports 105 and 106 have terminating impedances 109 and 110 each being $Z_0$. The impedance of lines 100 and loop 102 is $Z_A$ and the impedance of line 101 is $Z_B$.

Figure 10:
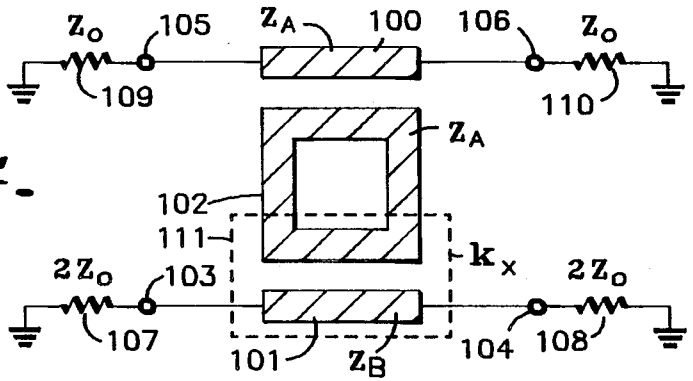
FIG. 10 is a schematic circuit of an equivalent circuit of the dual adjacent directional filter/combiner of FIG. 9.

FIG. 10 can be seen to show a non-symmetrical coupler 111, having a coupling coefficient, $k_x$, as well as the non-symetrical terminating impedance of coupler 111. The theory of non-symetrical directional couplers known in the art and may be found in an article by E. G. Crystal entitled "Coupled-Transmission-Line Directional Coupler With Coupled Lines of Unequal Characteristic Impedances", IEEE Trans., 1966, MTT-14, pp. 337–346.

It is sufficient for our purposes here to note that the following admittances are derived from the analysis of coupler 111;

$$Y_{Aoe} = (Y_o/2)[1 - k_x\sqrt{2}\ )/(1 - k_x^2)] \tag{26}$$

$$Y_{Aoo} = (Y_o/2)[1 + k_x\sqrt{2}\ )/(1 - k_x^2)]$$

$$Y_{Boe} = (Y_o)[(1 - k_x\sqrt{2}\ )/(1 - k_x^2)]$$

$$Y_{Boo} = (Y_o)[(1 + k_x\sqrt{2}\ )/(1 - k_x^2)]$$

where:

$Y_{Aoe}$=the admittance of loop 102 under even symmetry analysis;

$Y_{Aoo}$=the admittance of loop 102 under odd symmetry analysis;

$Y_{Boe}$=the admittance of line 101 under even symmetry analysis;

$Y_{Boo}$=the admittance of line 101 under odd symmetry analysis;

$Y_o/2$ is one-half the load admittance of ports 103 and 104; and $k_x$=is the coupling coefficient between loop 102 and line 101.

These equations serve to show, as set out in the Crystal article, that the circuit of FIG. 10 will operate as a directional filter. By using the reverse theory of symmetry used before, if the equivalent circuit will operate as a directional filter then the original circuit will operate as a directional filter, or in this case as a dual adjacent directional filter/combiner.

Thus, it is apparent that there has been provided in accordance with the invention, a device and method that fully satisfies the objects, aims, and advantages set forth above.

It has been shown that the present invention provides an apparatus and method that requires fewer components than the prior art; results in fewer losses; and is more economical to produce.

While the invention has been described in conjunction with specific embodiments thereof, it is evident that many alterations, modifications, and variations will be apparent to those skilled in the art in light of the foregoing description. Accordingly, it is intended to embrace all such alterations, modifications and variations in the appended claims.

I claim:

1. A dual adjacent directional filter (DADF) for filtering/combining a signal having a wavelength ($\lambda_g$), said DADF having first, second, third, fourth, fifth and sixth ports, said DADF comprising:

a first transmission line for transmitting said signal, said first transmission line having a first end, a second end, and a characteristic impedance value ($Z_o$), said first end of said first transmission line being coupled to said third port of said DADF and said second end of said first transmission line being coupled to said fourth port of said DADF;

a second transmission line for transmitting said signal, said second transmission line having a first end, a second end, and a characteristic impedance value ($Z_o$), said first end of said second transmission line being coupled to said fifth port of said DADF, said second end of said second transmission line being coupled to said sixth port of said DADF and said second transmission line being juxtaposed to said first transmission line;

a third transmission line having a first end, a second end, an impedance ($Z_0/2$), and a length of one-quarter of said wavelength ($\lambda_g/4$), said third transmission line being disposed between said first and second transmission lines;

a fourth transmission line having a first end, a second end, an impedance ($Z_0\sqrt{\beta/(2(\beta-1))}$), where $\beta$ is a coupling coefficient, and a length of one-quarter of said wavelength ($\lambda_g/4$), said second end of said fourth transmission line being coupled to said first end of said third transmission line;

a fifth transmission line having a first end, a second end, an impedance ($Z_0\sqrt{\beta/(2(\beta-1))}$), where $\beta$ is a coupling coefficient, and a length of one-quarter of said wavelength ($\lambda_g/4$), said first end of said fifth transmission line being coupled to said second end of said third transmission line;

a sixth transmission line having a first end, a second end, and a characteristic impedance value ($Z_0$), said first end of said sixth transmission line being coupled to said first port of said DADF and said second end of said sixth transmission line being coupled to said first end of said fourth transmission line; and;

a seventh transmission line having a first end, a second end, and a characteristic impedance value ($Z_0$), said first end of said seventh transmission line being coupled to said second end of said fifth transmission line and said second end of said seventh transmission line being coupled to said second port of said DADF;

first filtering means for filtering said signal, said first filtering means being disposed between said first transmission line and said; third transmission line second filtering means for filtering said signal, said second filtering means being disposed between said second transmission line and said third transmission line.

2. The DADF of claim 1 wherein said first filtering means comprises a first pair of transmission lines, each line of said first pair having a length equal to one-half of said wavelength ($\lambda_g/2$), a first end and a second end, said first ends being disposed toward said first transmission line and separated from each other by a distance equal to three-quarters of said wavelength ($3\lambda_g/4$), said second ends being disposed towards said third transmission line and separated from each other by a distance equal to one-quarter of said wavelength ($\lambda_g/4$).

3. The DADF of claim 1 wherein said second filter means comprises a second pair of transmission lines, each line of said second pair having a length equal to one-half of said wavelength ($\lambda_g/2$), a first end and a second end, said first ends being disposed towards said second transmission line and separated from each other by a distance equal to three-quarters of said wavelength ($3\lambda_g/4$), said second ends being disposed toward said third transmission line and separated from each other by a distance equal to one-quarter of said wavelength ($\lambda_g/4$).

4. The DADF of claim 1 wherein said first filtering means comprises:

a first resonator being disposed between said first transmission line and said third transmission line; and a second resonator being disposed between said first transmission line and said third transmission line, said second resonator, being disposed a distance equivalent to one-quarter of said wavelength ($\lambda_g/4$) from said first resonator.

5. The DADF of claim 1 wherein said second filtering means comprises:

a third resonator being disposed between said second transmission line and said third transmission line; and a fourth resonator being disposed between said second transmission line and said third transmission line, said second resonator being disposed a distance equivalent to one-quarter of said wavelength ($\lambda_g/4$) from said third resonator.

6. The DADF of claim 1 wherein said first filtering means comprises a first transmission loop having an electrical length equivalent to said wavelength ($\lambda_g$), said first transmission loop being disposed between said third transmission line and said first transmission line, said first transmission loop having a first coupling coefficient ($k_x$) between said loop and said third transmission line and a second coupling coefficient ($k_o$) between said loop and said first transmission line.

7. The DADF of claim 1 wherein said second filtering means comprises a second transmission loop having an electrical length equivalent to said wavelength ($\lambda_g$), said second transmission loop being disposed between said third transmission line and said second transmission line, said second transmission loop having a first coupling coefficient ($k_x$) between said loop and said third transmission line and a second coupling coefficient ($k_o$) between said loop and said second transmission line.

8. A dual adjacent directional filter (DADF) for filtering/combining a signal having a wavelength ($\lambda_g$), said DADF having first, second, third, fourth, fifth and sixth ports, said DADF comprising:

a first transmission line having a first end, a second end, and a characteristic impedance value ($Z_0$), said first end of said first transmission line being coupled to said third port of said DADF and said second end of said first transmission line being coupled to said fourth port of said DADF;

a second transmission line having a first end, a second end, and a characteristic impedance value ($Z_0$), said first end being coupled to said fifth port of said DADF, said second end being coupled to said sixth port of said DADF and said second transmission line being juxtaposed to said first transmission line;

a third transmission line having a first end, a second end, an impedance ($Z_0/2$), and a length of one-quarter of said wavelength ($\lambda_g/4$), said third transmission line being disposed between said first and second transmission lines;

a fourth transmission line having a first end, a second end, an impedance ($Z_0\sqrt{\beta(2(\beta-1))}$), where $\beta$ is a coupling coefficient, and a length of one-quarter of said wavelength ($\lambda_g/4$), said second end of said fourth transmission line being coupled to said first end of said third transmission line;

a fifth transmission line having a first end, a second end, an impedance ($Z_0\sqrt{\beta/(2(\beta-1))}$), where $\beta$ is a coupled coefficient, and a length of one-quarter of said wavelength ($\lambda_g/4$), said first end of said fifth transmission line being coupled to said second end of said third transmission line;

a sixth transmission line having a first end, a second end, and a characteristic impedance value ($Z_0$), said first end of said sixth transmission line being coupled to said first port of said DADF and said second end of said sixth transmission line being coupled to said first end of said fourth transmission line;

a seventh transmission line having a first end, a second end, and a characteristic impedance value ($Z_0$), said first end of said seventh transmission line being coupled to said second end of said fifth transmission line and said second end of said seventh transmission line being coupled to said second port of said DADF;

a first pair of transmission lines, each line of said first pair having a length equal to one-half of said wavelength ($\lambda_g/2$), a first end and a second end, said first ends being disposed towards said first transmission line and separated from each other by a distance equal to three-quarters of said wave length ($3\lambda_g/4$), said second ends being disposed towards said third transmission line and separated from each other by a distance equal to one-quarter of said wavelength ($\lambda_g/4$); and a second pair of transmission lines, each line of said second pair having a length of one-half of said wavelength ($\lambda_g/2$), a first end and a second end, said first ends being disposed toward said second transmission line and separated from each other by a distance equal to three-quarters of said wavelength ($3\lambda_g/4$), said second ends being disposed towards said third transmission line and separated from each other by a distance equal to one-quarter of said wavelength ($\lambda_g/4$).

9. A dual adjacent directional filter (DADF) for filtering/combining a signal having a wavelength ($\lambda_g$), said DADF having a first, second, third, fourth, fifth and sixth ports, said DADF comprising:

a first transmission line having a first end and a second end, said first end being coupled to said third port of said DADF;

a first curved transmission line having a first end, a second end, and having an electrical length equivalent to three-quarters of said wavelength ($3\lambda_g/4$), said first and second ends being physically disposed a distance equivalent to one-quarter of said wavelength ($\lambda_g/4$) apart, said first end being coupled to said second end of said first transmission line;

a second transmission line having a first end and a second end, said first end being coupled to said second end of said first curved transmission line and said second end being coupled to said fourth port of said DADF;

a third transmission line having a first end and a second end, said first end being coupled to said fifth port of said DADF and said third transmission line being juxtaposed to said first transmission line;

a second curved transmission line having a first end, a second end, and having an electrical length equivalent to three-quarters of said wavelength ($3\lambda_g/4$), said first and second ends being physically disposed a distance equivalent to one-quarter of said wavelength ($\lambda_g/4$) apart, said first end being coupled to said second end of said third transmission line and said second curved transmission line being contoured away from said first curved transmission line;

a fourth transmission line having a first end and a second end, said first end being coupled to said second end of said second curved transmission line and said second end being coupled to said sixth port of said DADF;

a fifth transmission line having a first end, a second end, an impedance ($Z_0/2$) and a length of one-quarter of said wavelength ($\lambda_g/4$), said fifth transmission line being disposed between said first and second curved transmission lines;

a sixth transmission line having a first end, a second end, an impedance $Z_0\sqrt{\beta/(2(\beta-1))}$, where $\beta$ is a coupling coefficient, and a length of one-quarter of said wavelength ($\lambda_g/4$), said second end of said sixth transmission line being coupled to said first end of said fifth transmission line;

a seventh transmission line having a first end, a second end, an impedance ($Z_0\sqrt{\beta/(2(\beta-1))}$), where $\beta$ is a coupling coefficient, and a length of one-quarter of said wavelength ($\lambda_g/4$), said first end of said seventh transmission line being coupled to said second end of said fifth transmission line;

an eighth transmission line having a first end, a second end, and a characteristic impedance value ($Z_0$), said first end being coupled to said first port of said DADF and said second end being coupled to said first end of said sixth transmission line;

a ninth transmission line having a first end, a second end and a characteristic impedance value ($Z_0$), said first end being coupled to said second end of said seventh transmission line and said second end being coupled to said second port of said DADF;

a first resonator being disposed between said first curved transmission line and said fifth transmission line;

a second resonator being disposed between said first curved transmission line and said fifth transmission line, said second resonator being physically disposed a distance equivalent to one-quarter of said wavelength ($\lambda_g/4$) from said first resonator;

a third resonator being disposed between said second curved transmission line and said fifth transmission line, and a fourth resonator being disposed between said second curved transmission line and said fifth transmission line, said fourth resonator being physically disposed a distance equivalent to one-quarter of said wavelength ($\lambda_g/4$) from said third resonator.

* * * * *